US010507509B2

(12) United States Patent
Huang

(10) Patent No.: US 10,507,509 B2
(45) Date of Patent: Dec. 17, 2019

(54) PIPE EXPANDING DEVICE WITH A PIPE-LENGTH FIXING ASSEMBLY

(71) Applicant: YUNG CHI INDUSTRY CO., LTD., Taichung (TW)

(72) Inventor: Wu-Sheng Huang, Taichung (TW)

(73) Assignee: Yung Chi Industry Co., Ltd., Taichung (TW)

( * ) Notice: Subject to any disclaimer, the term of this patent is extended or adjusted under 35 U.S.C. 154(b) by 439 days.

(21) Appl. No.: 15/408,981

(22) Filed: Jan. 18, 2017

(65) Prior Publication Data

US 2018/0200776 A1 Jul. 19, 2018

(51) Int. Cl.
*B21D 41/02* (2006.01)

(52) U.S. Cl.
CPC ..... *B21D 41/026* (2013.01)

(58) Field of Classification Search
CPC .... B21D 41/02; B21D 41/021; B21D 41/025; B21D 41/026; B21D 39/08
See application file for complete search history.

(56) References Cited

U.S. PATENT DOCUMENTS

2013/0133394 A1* 5/2013 Hasenberg ..... B21D 41/021 72/312

* cited by examiner

*Primary Examiner* — Debra M Sullivan
(74) *Attorney, Agent, or Firm* — Wang Law Firm, Inc.

(57) ABSTRACT

A pipe expanding device with a pipe-length fixing assembly is suitable for holding a pipe with a connecting end, and includes: a body including a first space and a second space; a clamping unit detachably disposed in the first space, and provided for insertion of the pipe, wherein the connecting end of the pipe is able to move back and forth within the second space; and the pipe-length fixing assembly is disposed in the second space and able to move back and forth toward the first space, and the connecting end of the pipe is stopped against the pipe-length fixing assembly. The pipe expanding device is capable of precisely fixing the expanding length, and improving the sealing of the joint between expanded pipes, and the pipe expanding operation is not limited by the user's experience.

4 Claims, 12 Drawing Sheets

PIPE EXPANDING DEVICE WITH A PIPE-LENGTH FIXING ASSEMBLY

BACKGROUND

Field of the Invention

The present invention relates to a pipe expanding device, and more particularly to a pipe expanding device with a pipe-length fixing assembly.

Related Prior Art

Pipe expanding devices can find application in many fields, such as construction engineering, hydraulic and electric piping, air conditioning piping. As shown in FIG. 1, during pipe expanding operation, a pipe 10 is clamped in a clamping recess 111 defined between two clamping seats 11 which are disposed in a first space 121 of a clamping body 12, in such a manner that the clamping seats 11 are abutted against the surface of a base 122 of the clamping body 12, so that the clamping seats 11 won't fall off of the first space 121. Then, pulling a handle 131 of a fastener 13 can rotate the threaded shaft 132 until a pressing portion 133 of the fastener 13 presses against the clamping seats 11, so that the clamping seats 11 are fixed. Then, operating the handle 141 of a drive unit 14 can move a movable member 142 toward the clamping seats 11, so that the movable member 142 can push the inner surface of the pipe 10 to cause deformation of the pipe 10, and the outer surface of the pipe 10 is pressed against the pipe-expanding recess 112, and thus the pipe expanding operation is completed.

However, the expanding length (machining dimension) of the pipe 10 is closely related to the diameter of the same. Once the reserved machining or expanding length of the pipe 10 is not in line with the diameter of the pipe 10, then the sealing effect of the connection of the expanded pipe 10 with other pipes will be adversely affected. The existing pipe expanding operation requires the user to decide the reserved machining length of the pipe 10 by the user's individual experience and skills. With different personal experiences, the reserved expanding length also varies, as a result, the connection can be tightly sealed when the expanded pipes are connected.

The present invention has arisen to mitigate and/or obviate the afore-described disadvantages.

SUMMARY

One objective of the present invention is to provide a pipe expanding device with a pipe-length fixing assembly, which is capable of precisely fixing the expanding length, and improving the sealing of the joint between expanded pipes, and the pipe expanding operation is not limited by the user's experience.

To achieve the above objective, a pipe expanding device with a pipe-length fixing assembly provided by the present invention is suitable for holding a pipe with a connecting end, and comprises: a body including a first space and a second space; a clamping unit detachably disposed in the first space, and provided for insertion of the pipe, wherein the connecting end of the pipe is able to move back and forth within the second space; and the pipe-length fixing assembly is disposed in the second space and able to move back and forth toward the first space, and the connecting end of the pipe is stopped against the pipe-length fixing assembly.

Preferably, the first and second spaces are connected to each other, the second space is defined by a lateral portion and an opposite lateral working portion, an adjustment hole is formed in the lateral working portion and extends in a moving direction of the pipe, and the pipe-length fixing assembly is disposed in the adjustment hole of the second space and able to move back and forth repeatedly.

Preferably, the pipe-length fixing assembly includes a positioning unit and an adjustment unit, the positioning unit includes a positioning head disposed in the second space and abutted against an inner surface of the lateral working portion, and a positioning body disposed in the adjustment hole, and the adjustment unit includes an adjustment head abutted against an outer surface of the lateral working portion, and an adjustment body adjustably disposed on the positioning body.

Preferably, a top surface of the lateral working portion is provided with scales, the pipe-length fixing assembly further includes an indicating member which includes an indicating portion movable along the scales, and a lateral indicating portion positioned between the adjustment head and the outer surface of the lateral working portion.

Preferably, the pipe-length fixing assembly includes a positioning unit and an adjustment unit, the positioning unit includes a movable member, and a positioning member, the movable member includes a movable body disposed in the adjustment hole, and a movable head disposed in the second space, the positioning member is connected to the movable head and adjustable between a first position and a second position, when in the first position, the positioning member is provided for abutting against the connecting end of the pipe, and when in the second position, the connecting end of the pipe is unable to abut against the positioning member, the adjustment unit includes an adjustment head abutted against an outer surface of the lateral working portion, and an adjustment body adjustably disposed on the movable body.

Preferably, a top surface of the lateral working portion is provided with scales, the pipe-length fixing assembly further includes an indicating member which includes an indicating portion movable along the scales, and a lateral indicating portion positioned between the adjustment head and the outer surface of the lateral working portion.

Preferably, the positioning unit further includes a ball, the movable head of the movable member is provided with a first groove and a second groove, the positioning member includes a positioning groove, the ball is selectively disposed between the positioning groove and the first groove, or between positioning groove and the second groove, when the positioning member is in the first position, the ball is located between the positioning groove and the first groove, and when the positioning member is in the second position, the ball is located between the positioning groove and the second groove.

The body is provided with the pipe-length fixing assembly, and the pipe-length fixing assembly is disposed in the second space and repeatedly movable toward the first space, and the connecting end of the pipe can be stopped against the pipe-length fixing assembly. By such arrangements, the position of the pipe-length fixing assembly on the body can be adjusted based on the diameter of the pipe, and the machining or expanding length of the pipe can be determined or fixed by moving the pipe toward the second space of the body until it is stopped against the pipe-length fixing assembly. Therefore, the pipe expanding operation is not limited by the user's experience, and the present invention provides a pipe expanding device which is capable of precisely fixing the expanding length, and improving the sealing of the joint between expanded pipes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
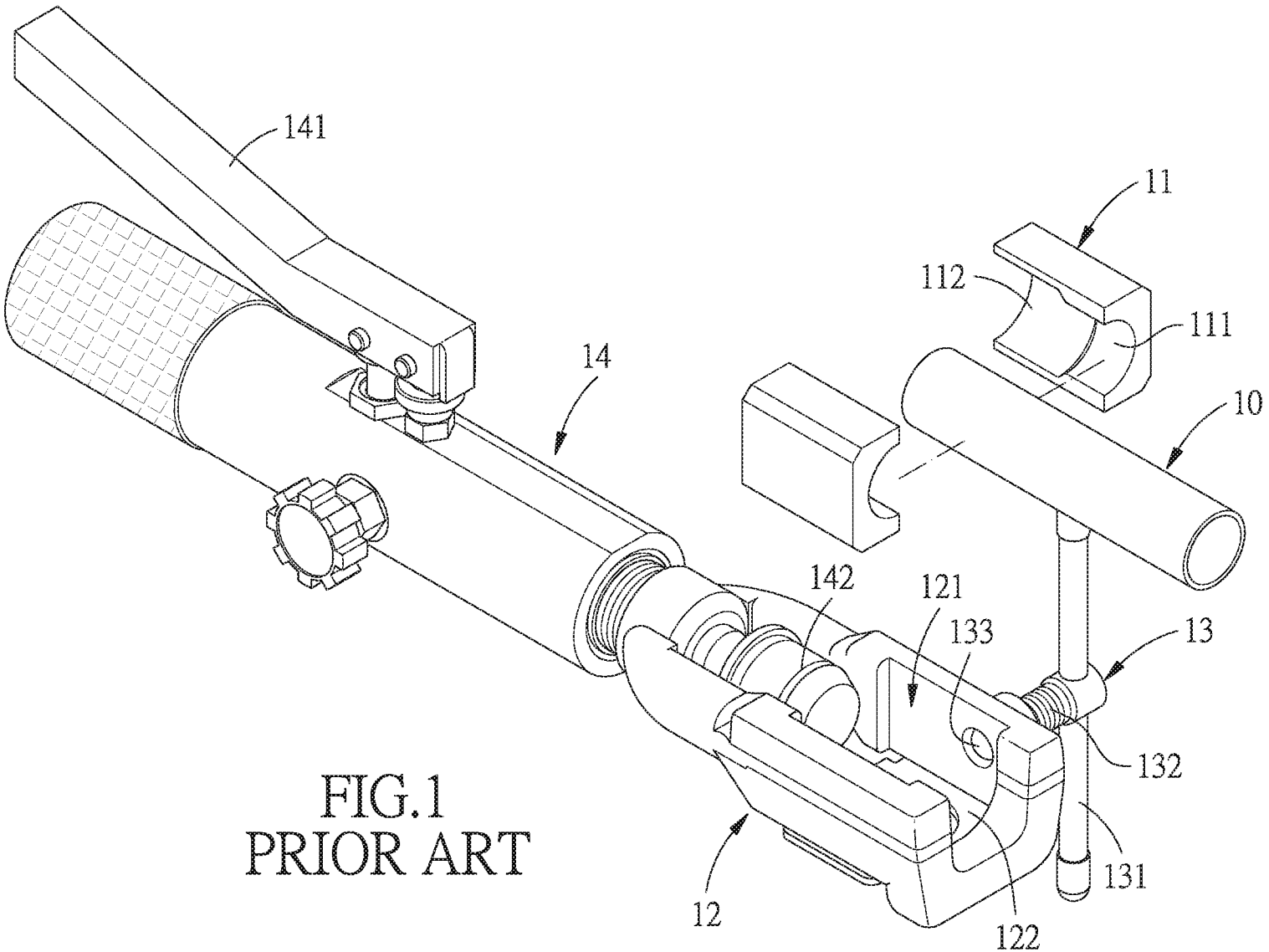
FIG.1 PRIOR ART
FIG. 1 is a perspective view of a convention pipe expanding device.
Figure 2:
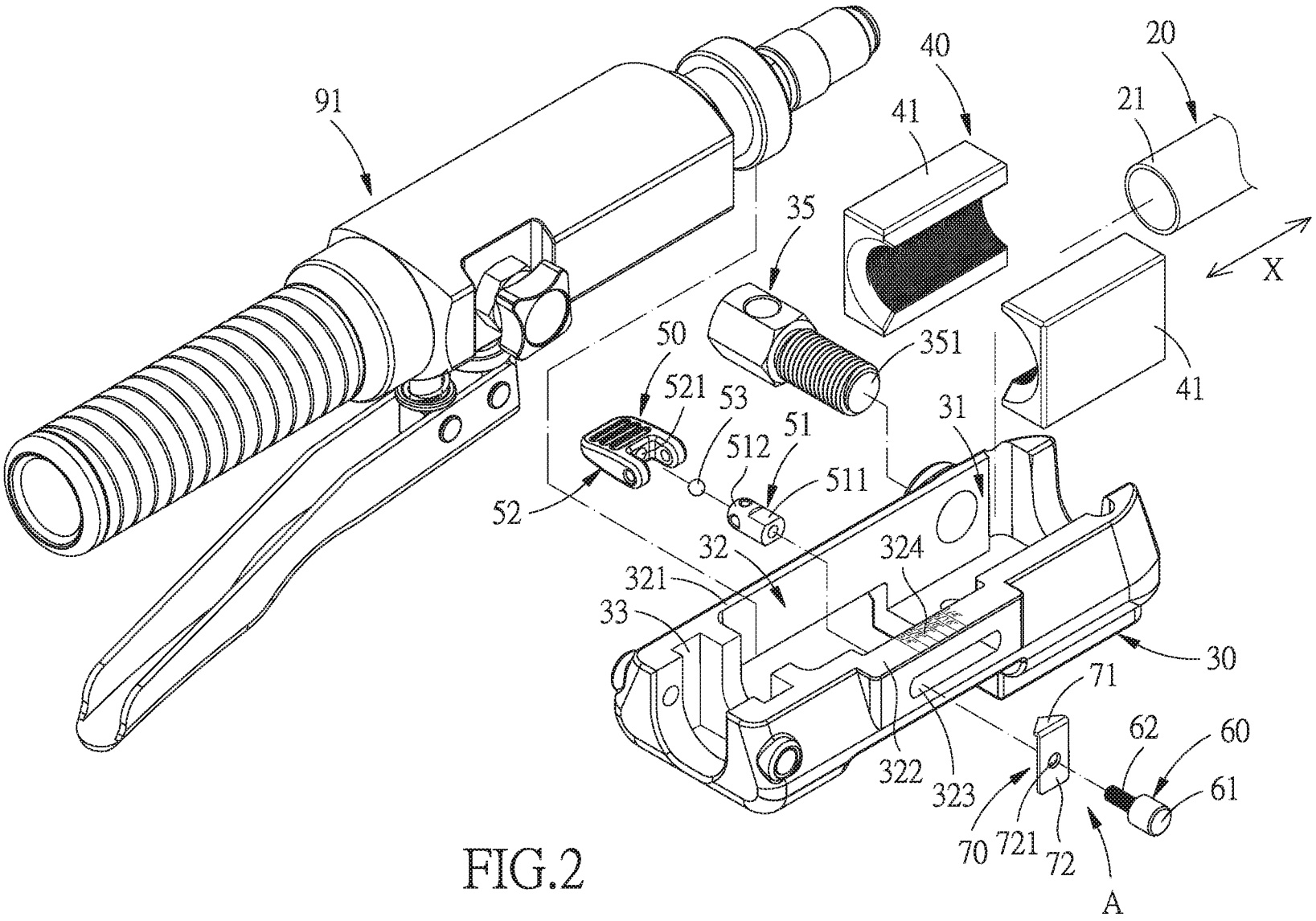
FIG. 2 is an exploded view showing a pipe expanding device with a pipe-length fixing assembly in accordance a first preferred embodiment of the present invention is separated from a drive unit.

The present invention will be clearer from the following description when viewed together with the accompanying drawings, which show, for purpose of illustrations only, the preferred embodiment in accordance with the present invention.

Referring to FIGS. 2-6, the pipe expanding device with a pipe-length fixing assembly A in accordance the first preferred embodiment of the present invention is suitable for holding a pipe 20 with a connecting end 21, and a drive unit 91 is detachably assembled to the pipe expanding device. The pipe expanding device comprises: a body 30, a clamping unit 40 and the pipe-length fixing assembly A.

The body 30 includes a first space 31 and a second space 32. In this embodiment, the first and second spaces 31, 32 are connected to each other. The second space 32 is defined by a lateral portion 321 and an opposite lateral working portion 322. An adjustment hole 323 is formed in the lateral working portion 322 and extends in a moving direction X of the pipe 20. The top surface of the lateral working portion 322 is provided with scales 324, including ¼ inch, 5/16 inch, ⅜ inch, ½ inch, ⅝ inch, ¾ inch and etc. The second space 32 further includes a holding recess 33 for holding the drive unit 91.

The clamping unit 40 is detachably disposed in the first space 31, and provided for insertion of the pipe 20, in such a manner that the connecting end 21 of the pipe 20 is able to move back and forth within the second space 32. In this embodiment, the clamping unit 40 includes two opposite clamping seats 41 which are coupled to each other to form the clamping unit 40.

The pipe-length fixing assembly A is disposed in the adjustment hole 323 of the second space 32 and able to move back and forth toward the first space 31. The pipe 20 has the connecting end 21 stopped against the pipe-length fixing assembly A. In this embodiment, the pipe-length fixing assembly A includes: a positioning unit 50, an adjustment unit 60, and an indicating member 70.

Figure 6:
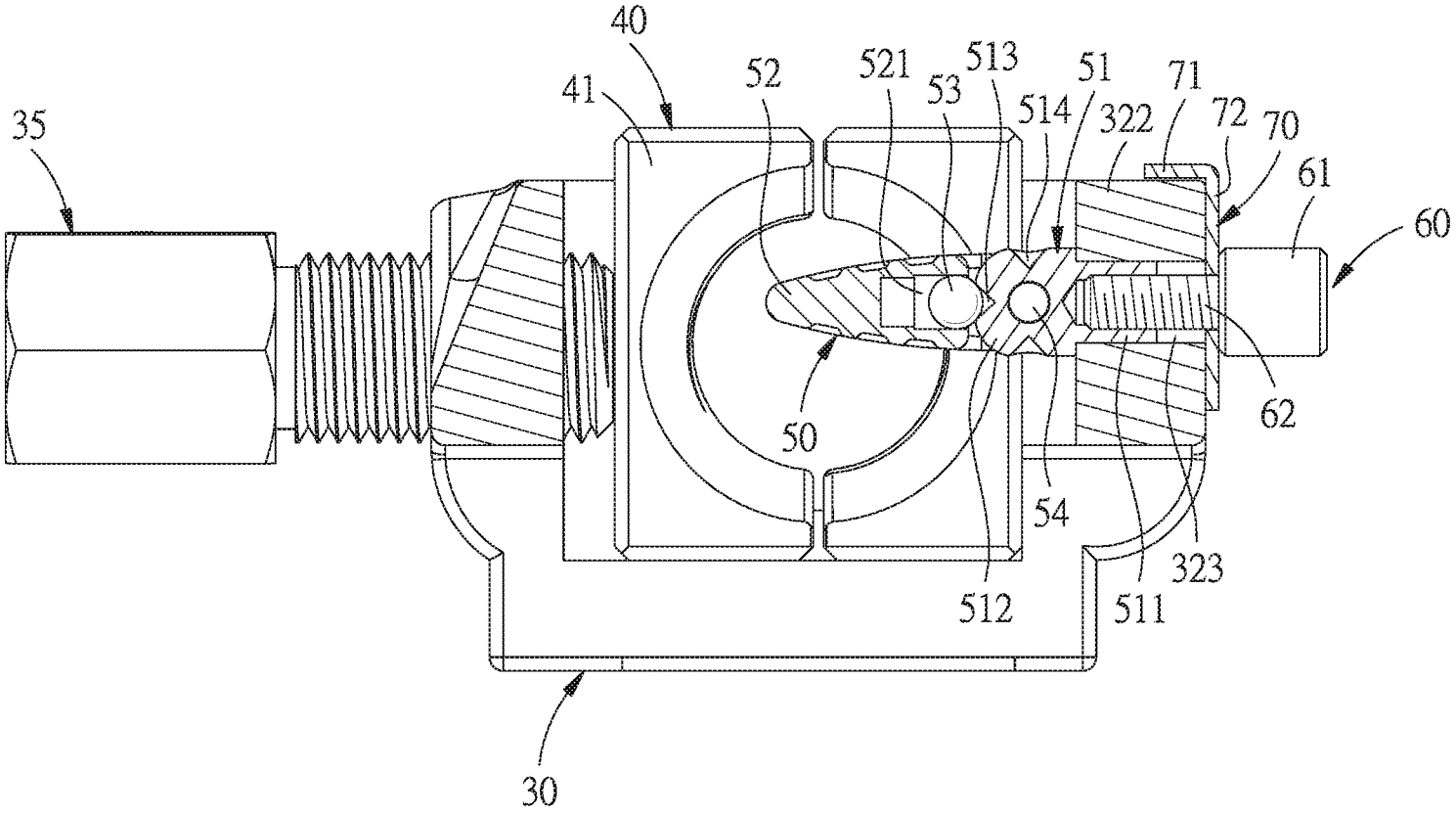
FIG. 6 is a cross sectional view taken along the line 6-6 of FIG. 4.
Figure 9:
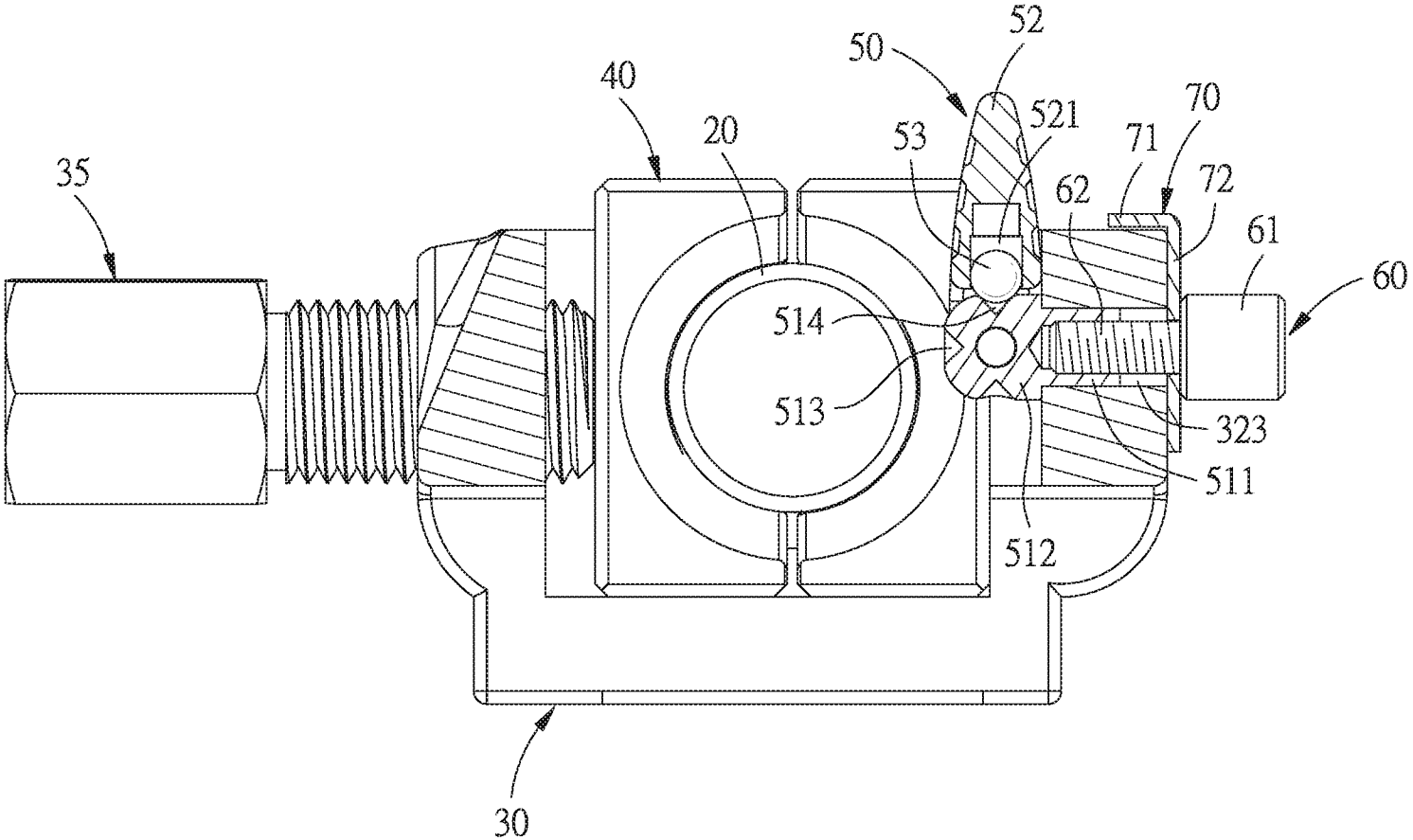
FIG. 9 is a cross sectional view of the first embodiment, showing that the clamping unit is in the second position.
Figure 10:
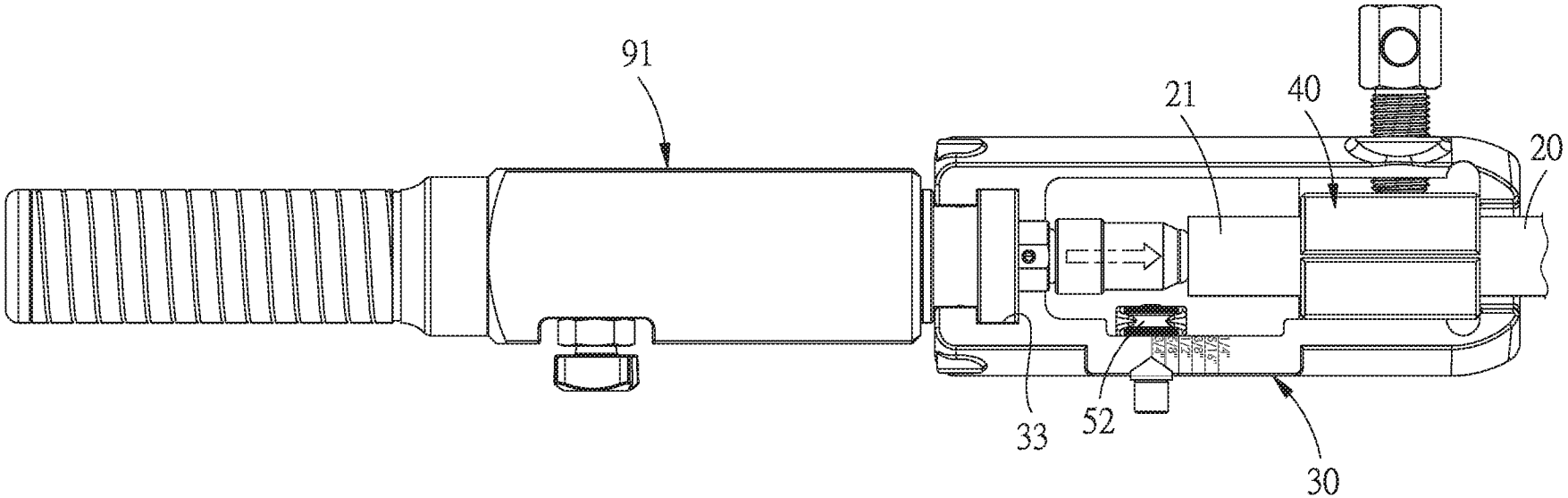
FIG. 10 is a top view of the first embodiment, showing that the drive unit is performing pipe expanding operation.

The positioning unit 50 includes a movable member 51, a positioning member 52 and a ball 53. The movable member 51 includes a movable body 511 disposed in the adjustment hole 323, and a movable head 512 disposed in the second space 32. The positioning member 52 is connected to the movable head 512 and adjustable between a first position (as shown in FIG. 6) and a second position (as shown in FIG. 9). When in the first position, the positioning member 52 is provided for abutting against the connecting end 21 of the pipe 20, and when in the second position, the positioning member 52 can not be provided for abutting against the connecting end 21 but can be used for pipe expanding operation. The positioning member 52 is pivotally connected to the movable member 51 by a pin 54. The movable head 512 of the movable member 51 is provided with a first groove 513 and a second groove 514. The positioning member 52 includes a positioning groove 521. The ball 53 is disposed between the positioning groove 521 and the first or second groove 513, 514. When the positioning member 52 is in the first position, the ball 53 is located between the positioning groove 521 and the first groove 513, and when the positioning member 52 is in the second position, the ball 53 is located between the positioning groove 521 and the second groove 514.

The adjustment unit 60 includes an adjustment head 61 abutted against the outer surface of the lateral working portion 322, and an adjustment body 62 adjustably disposed on the movable body 511. The adjustment body 62 here is screwed to the movable body 511, and they can also be connected or assembled in other ways.

The indicating member 70 includes an indicating portion 71 movable along the scales 324, and a lateral indicating portion 72 which can be positioned between the adjustment head 61 and the outer surface of the lateral working portion 322. In this embodiment, the lateral indicating portion 72 includes an inserting hole 721 for insertion of the adjustment body 62, so that the indicating member 70 moves along with the adjustment unit 60.

What mentioned above are the structures of the main components of the first embodiment, and the operation and function of the present invention are described as follows.

Figure 3:
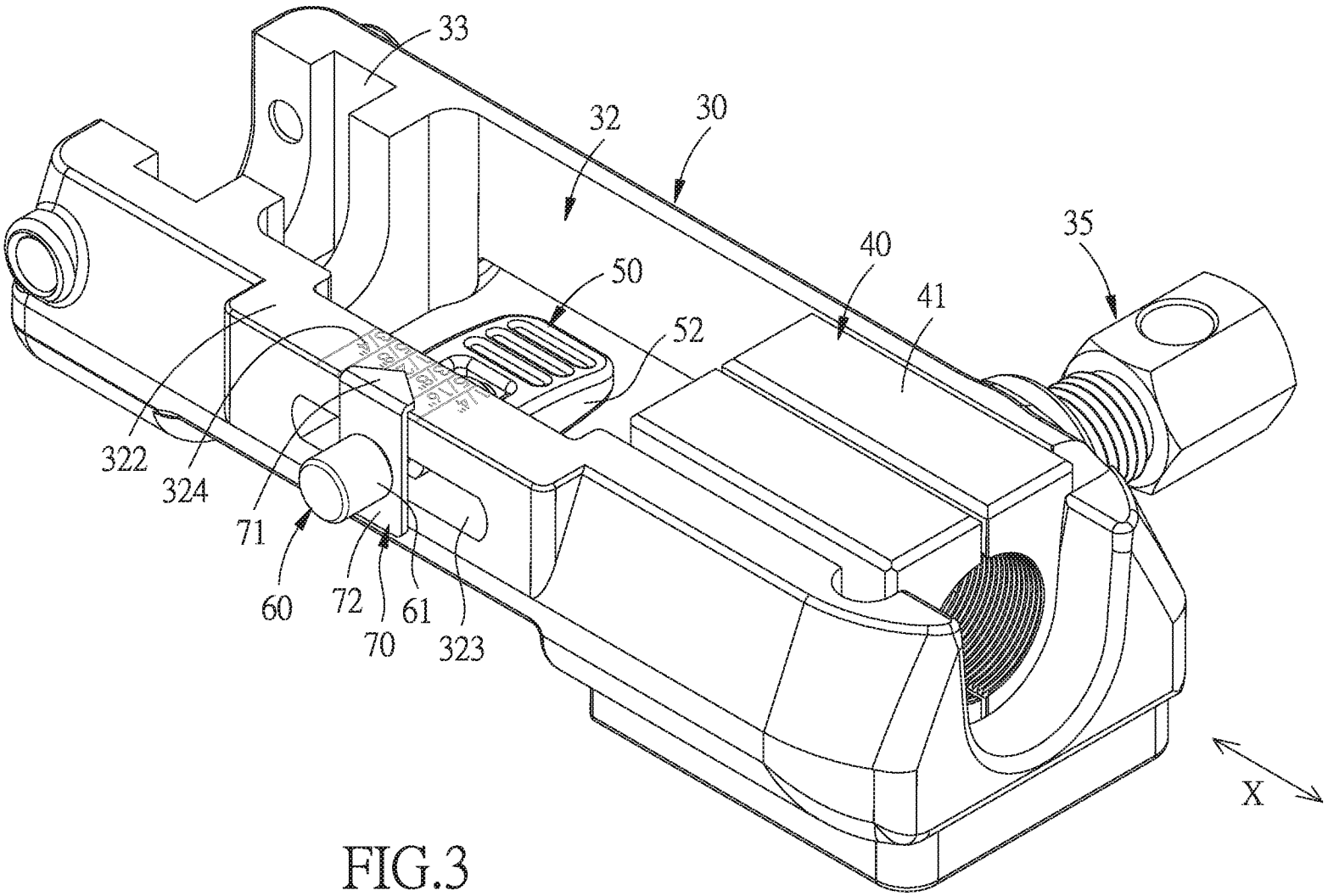
FIG. 3 is an assembly view of the first embodiment of the present invention.
Figure 4:
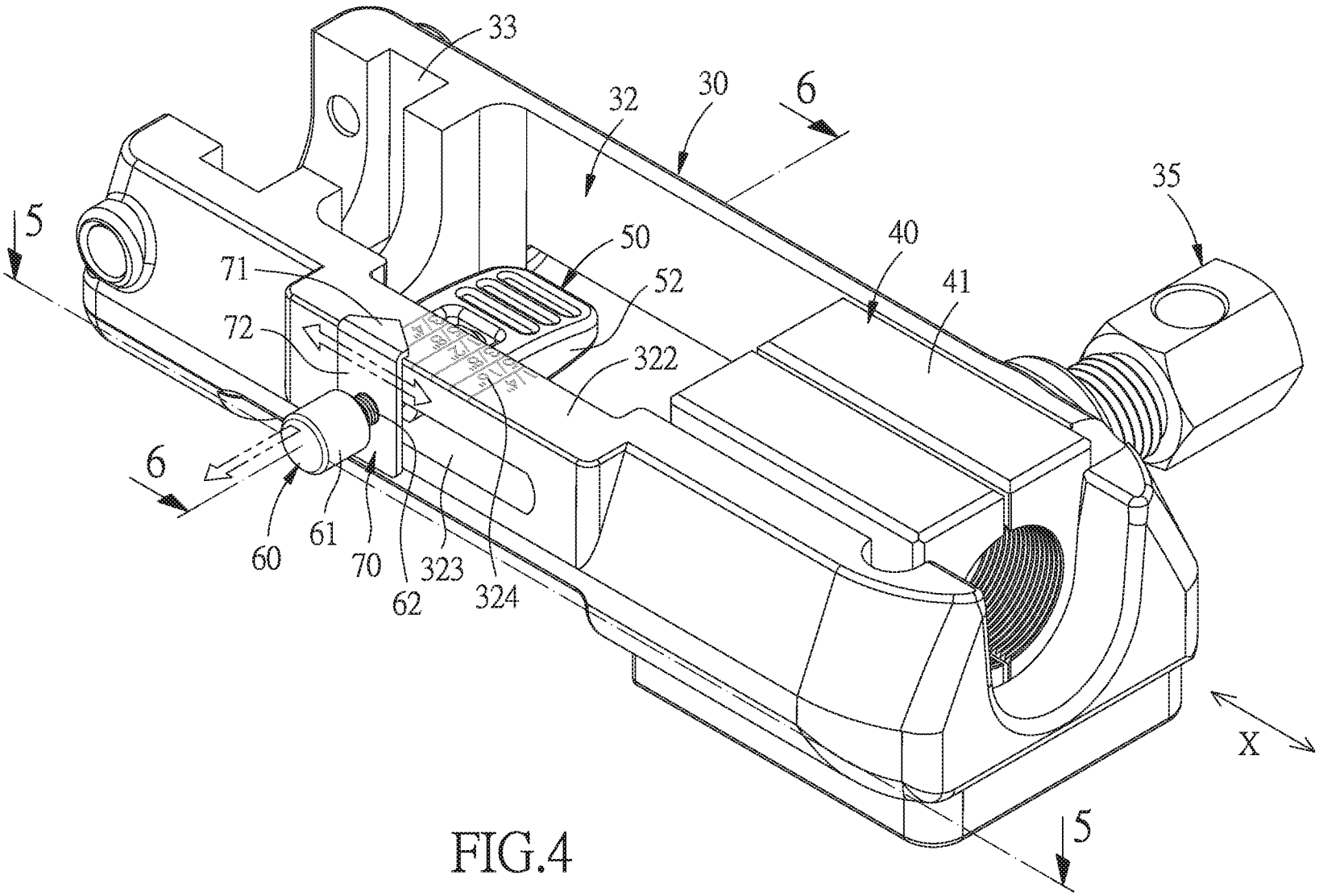
FIG. 4 is a perspective view of the first embodiment showing the position adjustment.
Figure 5:
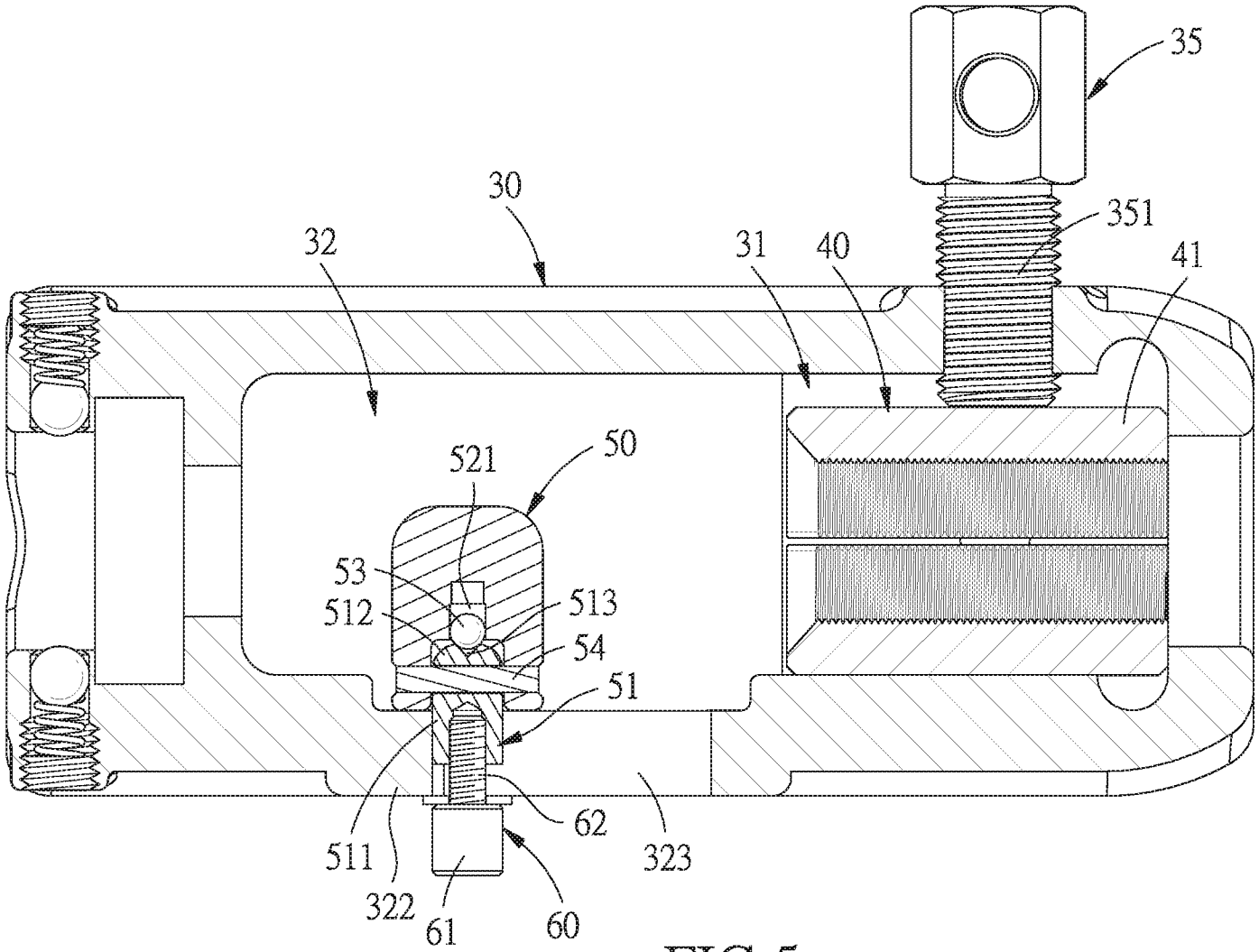
FIG. 5 is a cross sectional view taken along the line 5-5 of FIG. 4.
Figure 7:
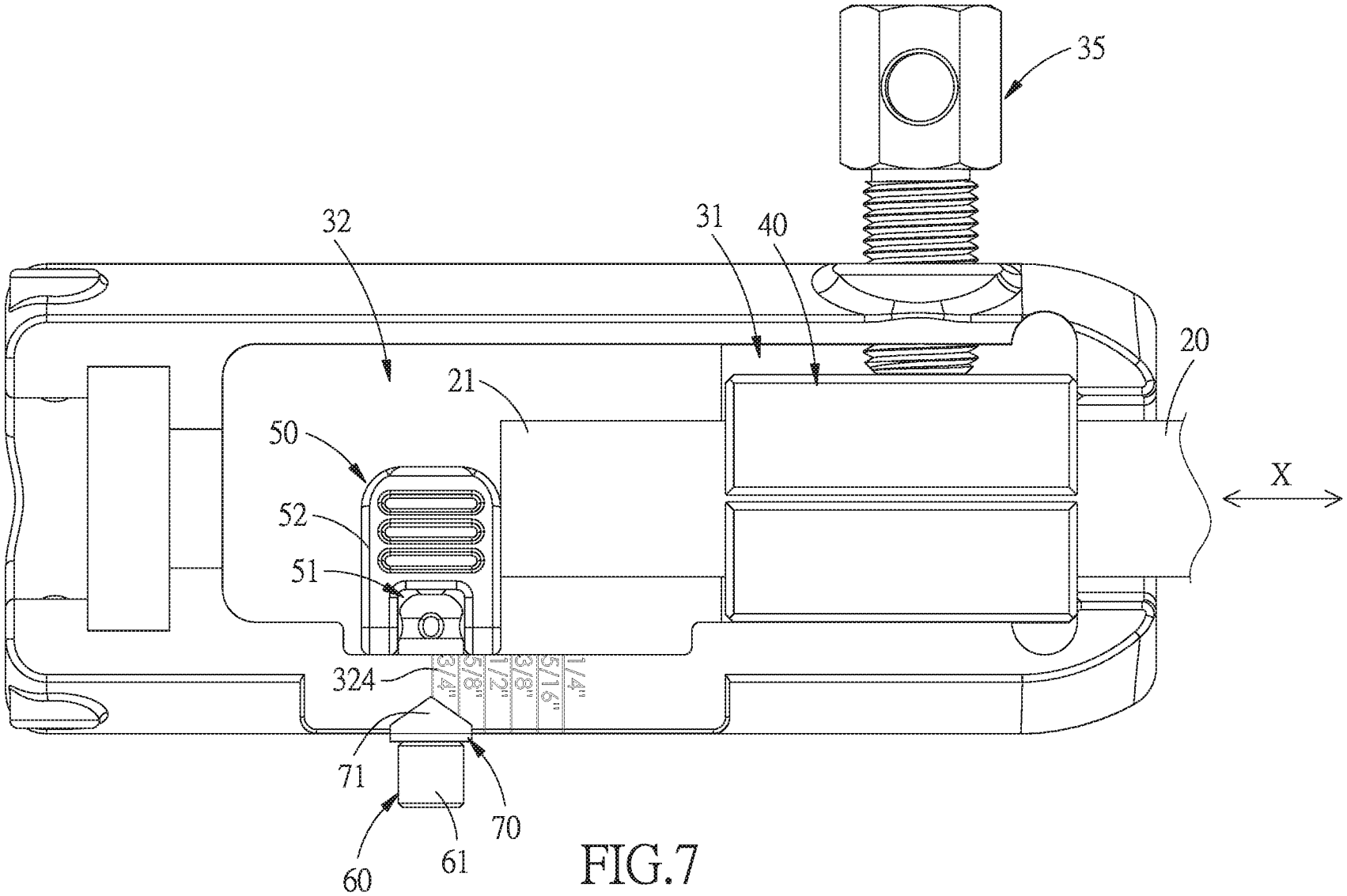
FIG. 7 is a top view of the first embodiment, showing that the pipe has been positioned after adjustment.
Figure 8:
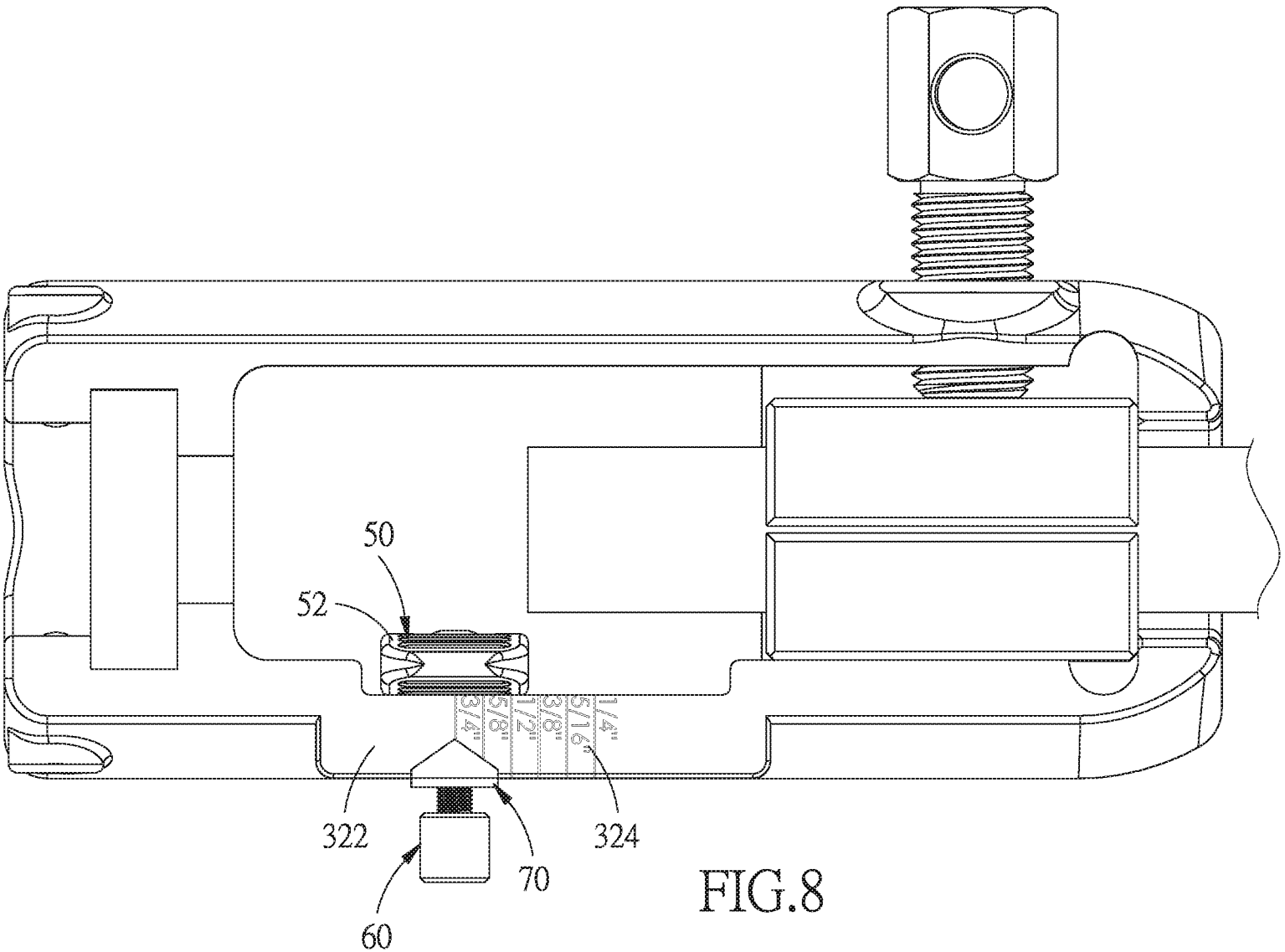
FIG. 8 is a top view of the first embodiment, showing that the clamping unit is in the second position.

As shown FIGS. 3 and 4, during pipe expanding operation, the user rotates the adjustment unit 60 to move it away from the movable member 51 of the positioning unit 50. Then, the position of the pipe-length fixing assembly A on the body 30 can be adjusted based on the diameter of the pipe 20, and the position adjustment is made by referring to the scales 324 to decide the position where the pipe 20 can be stopped or abutted. After the position of the pipe-length fixing assembly A is adjusted, the user can rotate the adjustment unit 60 again to move it toward the movable member 51 of the positioning unit 50 until it is fixed to the lateral working portion 322 of the body 30. At this moment, as shown in FIG. 7, the pipe 20 can be moved within the clamping unit 40 toward the second space 32 of the body 30 until the connecting end 21 of the pipe 20 is abutted against the positioning member 52 of the positioning unit 50, so that the machining length of the pipe 20 can be fixed.

The body 30 is provided with the pipe-length fixing assembly A, and the pipe-length fixing assembly A is disposed in the second space 32 and repeatedly movable toward the first space 31, and the connecting end 21 of the pipe 20 can be stopped against the pipe-length fixing assembly A. By such arrangements, the position of the pipe-length fixing assembly A on the body 30 can be adjusted based on the diameter of the pipe 20, and the machining or expanding length of the pipe 20 can be determined or fixed by moving the pipe 20 toward the second space 32 of the body 30 until it is stopped against the pipe-length fixing assembly A. Therefore, the pipe expanding operation is not limited by the user's experience, and the present invention provides a pipe expanding device which is capable of precisely fixing the expanding length, and improving the sealing of the joint between expanded pipes.

It is to be noted that, as shown in FIGS. 7-10, when the machining length of the pipe 10 is fixed, a fixing member 35 of the body 30 is rotated until the pressing portion 351 presses against the clamping seats 41, consequently, the clamping seats 41 are fixed on the body 30 and clamped against the pipe 20. After that, the positioning member 52 is adjusted from the horizontal first position to the vertical second position, namely, the ball 53 is moved from the position between the positioning groove 521 and the first groove 513 to the position between the positioning groove 521 and the second groove 514. By such arrangements, the positioning member 52 is positioned after adjustment, and the drive unit 91 is allowed to perform pipe expanding operation without interfering with the positioning member 52.

Figure 11:
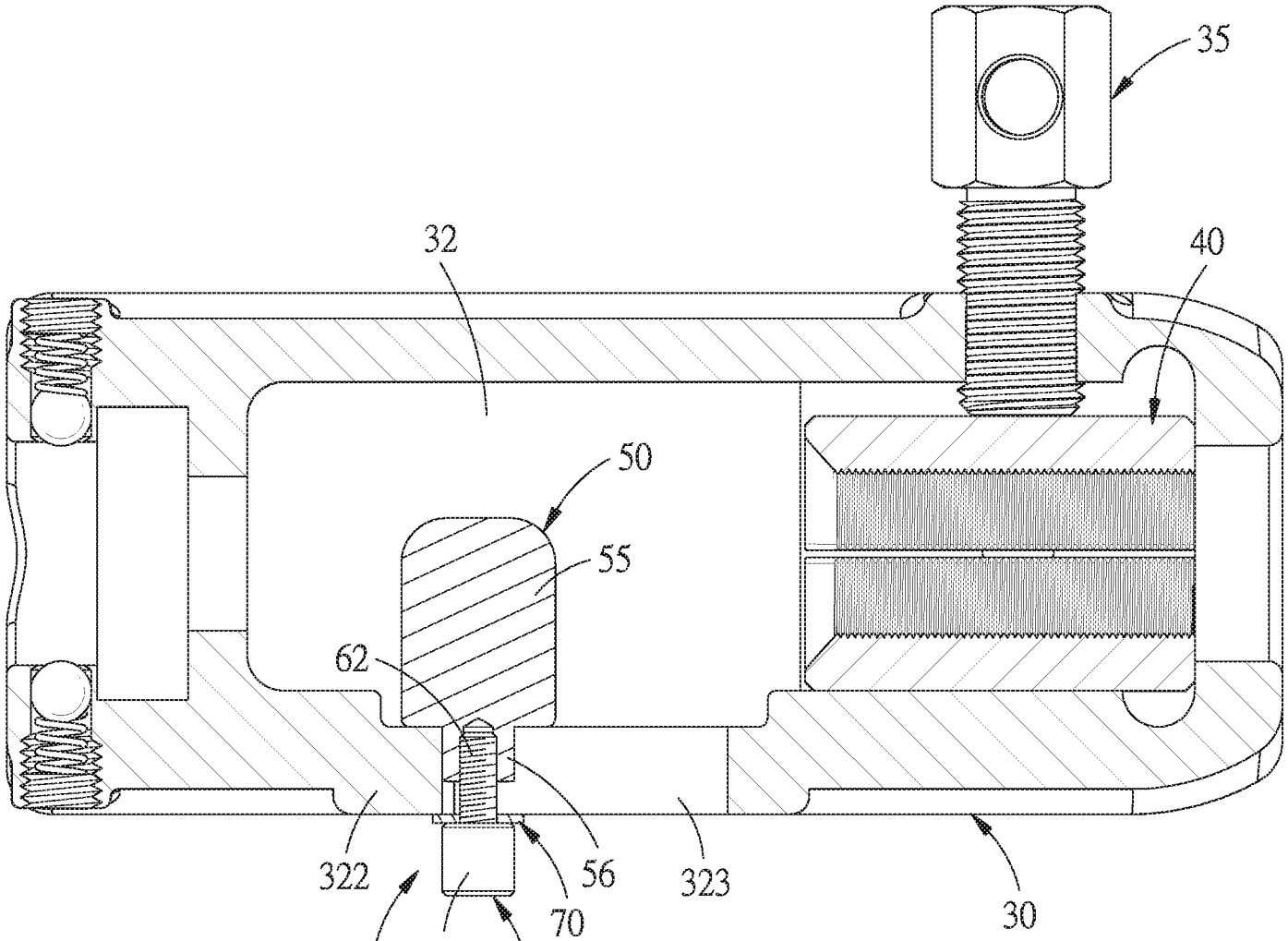
FIG. 11 is a cross sectional view of a pipe expanding device with a pipe-length fixing assembly in accordance with a second preferred embodiment of the present invention.
Figure 12:
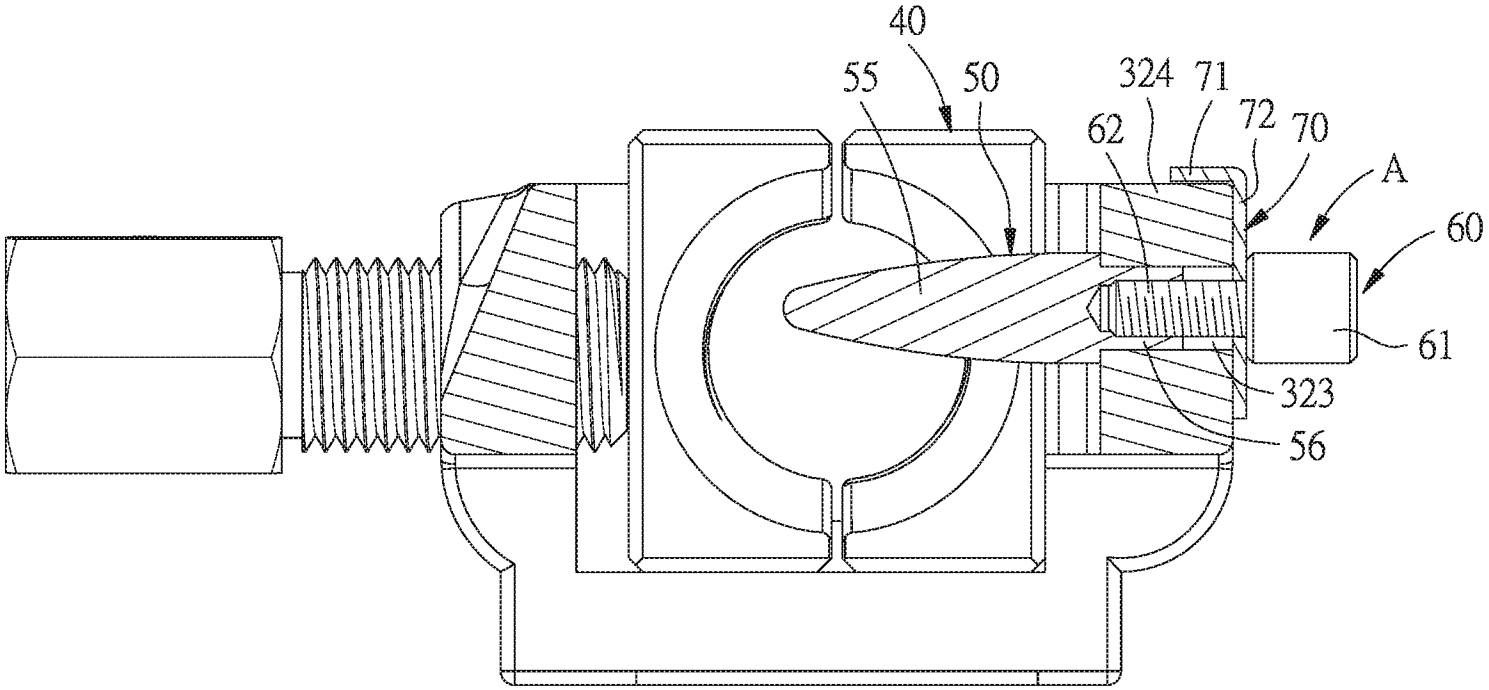
FIG. 12 is another cross sectional view of the pipe expanding device in accordance with the second preferred embodiment of the present invention.

Referring to FIGS. 11 and 12, a pipe expanding device with a pipe-length fixing assembly A in accordance the second preferred embodiment of the present invention is similar to the first embodiment, except that:

The pipe-length fixing assembly A includes: a positioning unit 50, an adjustment unit 60, and an indicating member 70. The positioning unit 50 includes a positioning head 55 disposed in the second space 32 and abutted against the inner surface of the lateral working portion 322, and a positioning body 56 disposed in the adjustment hole 323. The adjustment unit 60 includes an adjustment head 61 abutted against the outer surface of the lateral working portion 322, and an adjustment body 62 adjustably disposed on the positioning body 56. The adjustment body 62 here is screwed to the positioning body 56, and they can also be connected or assembled in other ways. The indicating member 70 includes an indicating portion 71 movable along the scales 324, and a lateral indicating portion 72 which can be positioned between the adjustment head 61 and the outer surface of the lateral working portion 322. With less components, the second embodiment provides a pipe expanding device which is capable of precisely fixing the expanding length, and improving the sealing of the joint between expanded pipes, and the pipe expanding operation is not limited by the user's experience.

While we have shown and described various embodiments in accordance with the present invention, it is clear to those skilled in the art that further embodiments may be made without departing from the scope of the present invention.

What is claimed is:

1. A pipe expanding device with a pipe-length fixing assembly, suitable for holding a pipe with a connecting end, and comprising:

a body including a first space and a second space;

a clamping unit detachably disposed in the first space, and the clamping unit being provided for the pipe to be inserted therein, wherein the connecting end of the pipe is able to move back and forth within the second space; and the pipe-length fixing assembly being disposed in the second space and able to move back and forth toward the first space, and the connecting end of the pipe is stopped against the pipe-length fixing assembly; and a drive unit mounted on the body for expanding the pipe;

wherein the first and second spaces are connected to each other, the second space is defined by a lateral portion and an opposite lateral working portion, an adjustment hole is formed in the lateral working portion and extends in a moving direction of the pipe, and the pipe-length fixing assembly is disposed in the adjustment hole of the second space and able to move back and forth repeatedly;

the pipe-length fixing assembly includes a positioning unit and an adjustment unit, the positioning unit includes a positioning head disposed in the second space and abutted against an inner surface of the lateral working portion, and a positioning body disposed in the adjustment hole, and the adjustment unit includes an adjustment head abutted against an outer surface of the lateral working portion, and an adjustment body adjustably disposed on the positioning body.

2. The pipe expanding device as claimed in claim 1, wherein a top surface of the lateral working portion is provided with scales, the pipe-length fixing assembly further includes an indicating member which includes an indicating portion movable along the scales, and a lateral indicating portion positioned between the adjustment head and the outer surface of the lateral working portion.

3. A pipe expanding device with a pipe-length fixing assembly, suitable for holding a pipe with a connecting end, and comprising:

a body including a first space and a second space;

a clamping unit detachably disposed in the first space, and the clamping unit being provided for the pipe to be inserted therein, wherein the connecting end of the pipe is able to move back and forth within the second space; and the pipe-length fixing assembly being disposed in the second space and able to move back and forth toward the first space, and the connecting end of the pipe is stopped against the pipe-length fixing assembly; and a drive unit mounted on the body for expanding the pipe;

the first and second spaces are connected to each other, the second space is defined by a lateral portion and an opposite lateral working portion, an adjustment hole is formed in the lateral working portion and extends in a moving direction of the pipe, and the pipe-length fixing assembly is disposed in the adjustment hole of the second space and able to move back and forth repeatedly;

wherein the pipe-length fixing assembly includes a positioning unit and an adjustment unit, the positioning unit includes a movable member, and a positioning member, the movable member includes a movable body disposed in the adjustment hole, and a movable head disposed in the second space, the positioning member is connected to the movable head and adjustable between a first position and a second position, when in the first position, the positioning member is provided for abutting against the connecting end of the pipe, and when in the second position, the connecting end of the pipe is unable to abut against the positioning member, the adjustment unit includes an adjustment head abutted against an outer surface of the lateral working portion, and an adjustment body adjustably disposed on the movable body;

wherein a top surface of the lateral working portion is provided with scales, the pipe-length fixing assembly further includes an indicating member which includes an indicating portion movable along the scales, and a lateral indicating portion positioned between the adjustment head and the outer surface of the lateral working portion.

4. The pipe expanding device as claimed in claim 3, wherein the positioning unit further includes a ball, the movable head of the movable member is provided with a first groove and a second groove, the positioning member includes a positioning groove, the ball is selectively disposed between the positioning groove and the first groove, or between positioning groove and the second groove, when the positioning member is in the first position, the ball is located between the positioning groove and the first groove, and when the positioning member is in the second position, the ball is located between the positioning groove and the second groove.

* * * * *